US007362195B2

(12) United States Patent
Chui

(10) Patent No.: US 7,362,195 B2
(45) Date of Patent: Apr. 22, 2008

(54) FERRO MAGNETIC METAL-INSULATOR MULTILAYER RADIO FREQUENCY CIRCULATOR

(75) Inventor: Siu-Tat Chui, Newark, DE (US)

(73) Assignee: University of Delaware, Newark, DE (US)

( * ) Notice: Subject to any disclaimer, the term of this patent is extended or adjusted under 35 U.S.C. 154(b) by 96 days.

(21) Appl. No.: 11/279,168

(22) Filed: Apr. 10, 2006

(65) Prior Publication Data

US 2006/0226926 A1 Oct. 12, 2006

Related U.S. Application Data

(60) Provisional application No. 60/670,247, filed on Apr. 12, 2005, provisional application No. 60/669,389, filed on Apr. 8, 2005.

(51) Int. Cl.
*H01P 1/383* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,433,649 B2 8/2002 Miura et al.
6,507,249 B1 * 1/2003 Schloemann ..... 333/1.1
2002/0039054 A1 4/2002 Kocharyan
2002/0093392 A1 7/2002 Ohata et al.
2002/0179931 A1 12/2002 Traylor

OTHER PUBLICATIONS

H. Bosma, "On Stripline Y-Circulation at UHF," *IEEE Transactions on Microwave Theory and Techniques*, MTT-12, pp. 61-72. Jan. 1984.

Fay et al. "Operation of the Ferrite Junction Circulator", *IEEE Transactions on Microwave Theory and Techniques*, pp. 15-27. Jan. 1965.

International Search Report for PCT International Application No. PCT/US06/13472 mailed Sep. 12, 2007.

* cited by examiner

*Primary Examiner*—Stephen E. Jones
(74) *Attorney, Agent, or Firm*—RatnerPrestia

(57) ABSTRACT

A directional R.F. circulator directs radio frequency signals without an external biasing magnetic field. Layers of ferromagnetic materials and insulating materials form a laminated nano-structure. The layers are selected to have a thickness smaller than the wavelength of the radio frequency signals, and smaller than the skin depth of the signals in the material. The ferromagnetic materials and insulators form a resonant cavity having a resonant frequency near the operating frequency for the signal. A plurality of connectors are located around the periphery of the laminated ferromagnetic material to provide input and output ports for the device. This circulator is compatible with semiconductor thin-film processing, and may be integrated onto a monolithic integrated circuit. A method of forming a directional R.F. circulator is also disclosed.

20 Claims, 1 Drawing Sheet

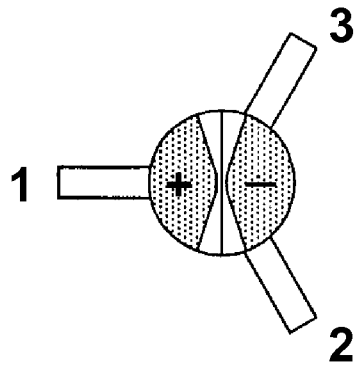
FIG. 1
(CONVENTIONAL)
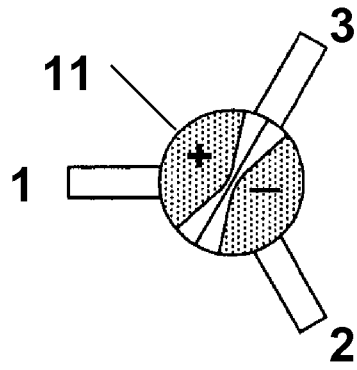
FIG. 2
(CONVENTIONAL)

FERRO MAGNETIC METAL-INSULATOR MULTILAYER RADIO FREQUENCY CIRCULATOR

CROSS REFERENCE TO RELATED APPLICATIONS

This Application claims the benefit under 35 U.S.C. §119(e) of U.S. Provisional Application 60/670,247 filed on Apr. 12, 2005 and U.S. Provisional Application 60/669,389 filed on Apr. 8, 2005, the entire contents of each application are incorporated herein by reference.

BACKGROUND

This disclosure relates to components for radio frequency signals in the microwave region. Specifically, a radio frequency (R.F.) circulator is disclosed comprising a ferromagnetic magnetic metal-insulator laminate structure which does not require an external magnetic field.

R.F. circulators are used in the processing of microwave signals as passive isolators that convey an electromagnetic wave in a single direction. This property allows a transmitter and receiver to share the same antenna. For instances, power from the transmitter applied to one port will go to a second antenna port of a three port circulator, and received energy the second port from the antenna will be directed to a third port of the circulator.

Conventional circulators use ferrites having an external biasing magnetic field. The circulator is essentially a circular capacitor where the material between the metal electrodes is made of ferrite, having a magnetization aligned perpendicular to the plane by an external biasing magnetic field. The device operates as a resonant cavity, where the resonant frequency for an electromagnetic wave going in the clockwise direction is different from that going in the counter clockwise direction. The operating frequency of the R.F. signal is close to one of the resonant frequencies to give the device its directional propagating properties.

The behavior of magnetic material for left/right-handed circularly polarized radiation produces the unidirectional circulator properties. As the frequency of the R.F. signal increases to a frequency comparable to the spin wave frequency of the ferrite, losses in efficiency occur. While magnetic metals have high spin wave frequencies, it is not possible to replace the insulating ferrite by a metal as the eddy current losses in a metal at lower frequencies will effectively limit the useful frequency range for the circulator.

Embodiments of this disclosure have been developed to reduce the losses incurred from eddy current generation in ferromagnetic metals and losses due to the lower spin wave frequency of the ferrites.

BRIEF SUMMARY

A directional R.F. circulator is disclosed which does not require an external magnetic field. Specifically, losses due to the lower spin wave frequency of the ferrite are avoided in accordance with various aspects of this disclosure.

This disclosure uses a completely different class of nanostructured material adapted to mimic the effect of a magnetic insulator, thereby allowing for a device operating at higher frequencies, and one in which the manufacturing process is compatible with current thin-film processing associated with microwave integrated circuit processing.

In one aspect of this disclosure, conventional ferrite material is replaced by a multilayer ferromagnetic metal-insulator structure where the thicknesses of the various layers are less than the skin depth and wavelength of the R.F. radiation.

A laminate structure comprising ferromagnetic materials and insulating materials is provided. Each of the layers of the laminate structure has a thickness which is smaller than the wave length of the incident radio frequency signal and smaller than the skin depth of the radio frequency signals, thus reducing the loss due to eddy currents in the laminate structure. The ferromagnetic materials and insulator laminate structure form a resonant cavity having a resonant frequency defined by the effective magnetic susceptibility and dielectric constant of the ferromagnet-insulator multilayer structure.

First, second and third connectors are disposed about the periphery of the laminate structure to provide for conventional circulator ports.

BRIEF DESCRIPTION OF THE DRAWINGS

FIG. 1 is a top-view of a conventional ferrite circulator not at the operating condition and where the power is split;

FIG. 2 is a view of a conventional circulator which is operated as a transmit receive switch.

DETAILED DESCRIPTION

Figure 3:
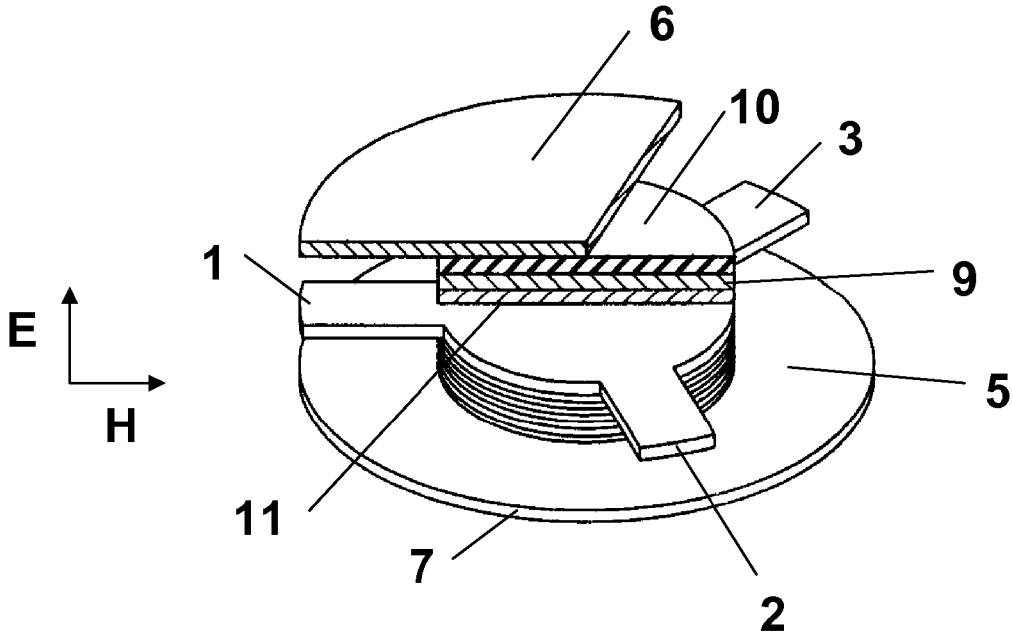
FIG. 3 shows a laminate structure of ferromagnetic materials and insulating materials in place of a ferrite in accordance with this disclosure.

Referring now to FIG. 1, a top-view of the wave pattern in a conventional ferrite circulator is shown where when not at the operating condition, equal energy transfers from port 1 to ports 2 and 3. The circulator comprises a ferrite disc, or plurality of ferrite discs, which have disposed about their periphery R.F. connection points 1, 2 and 3. The electric field of the resonant mode is perpendicular to the circulator, having, for example, the orientation indicated by "+" and "−". In the embodiment shown in FIG. 1, the circulator is not at the operating condition and power is divided between ports 2 and 3.

At the operating condition (due to an external magnetic field), for the resonant mode of interest, an electric null is created along the axis of port 3. This results in port 3 being essentially isolated from ports 1 and 2. Energy is transferred from port 1 to port 2.

The foregoing conventional R.F. circulators utilize ferrite material which are generally lossy at higher frequency R.F. signals because of spin wave generation in the ferrite material which effectively limits the usable frequency of the ferrite circulator.

FIG. 3 is an exploded isometric view of the circulator in accordance with an embodiment of this disclosure. The circulator includes a laminate structure 5 comprising alternate layers of insulation 9 and ferromagnetic material 10 which may be any magnetic material of large perpendicular anisotropy, examples of which are alloys or compounds of cobalt and platinum $Co_3Pt$ or $Fe_3Pt$. Other materials with large perpendicular anisotropy may also be used. Use of the word "large" with respect to perpendicular anisotropy is relative to conventional ferrites, and may be considered to be, for example, in the case of $Fe_3Pt$, an anisotropy field of $H_A$ of about 50 kOe (3.98 MA/m). For $Co_3Pt$, $H_A$ may be larger. In contrast, for the best ferrites, $H_A$ may be only about 19 kOe (1.51 MA/m).

The top and bottom layers 6 and 7 are metallic ground planes which support the propagation of waves which are launched from the input ports 1 to the remaining ports 2 and 3.

Each layer of the ferromagnetic metal-insulator multilayer structure has a thickness which is less than the skin depth and wavelength of the R.F. signal being propagated within the circulator. These thicknesses are generally less than nanometers, and much less than the skin depth for microwave frequencies. For a practical circulator, the multilayer structure is capped at the top and the bottom by metal electrodes. The total thickness of the multilayer structure should be larger than the skin depth of the electrodes on top and bottom (the "capacitor plates"). Taking the electrodes to be made of copper with a conductivity of approximately $5\times10^{17}$/sec (59.6 $10^6$/(Ω-m)), we find a Cu skin depth of the order of 500 nm for a wavelength of 5 mm. Multilayer structures of this total thickness are achievable experimentally. The electromagnetic wave propagates in the laminate structure according to a circulator mode, wherein the electric field E is perpendicular to the layers, and the magnetic field is parallel to them. The device operates as a resonant cavity, where the resonant frequency for the electromagnetic wave going clockwise is different from that of an electromagnetic wave going counter clockwise. The operating frequency of the device is close to one of these resonant frequencies which makes the device directional.

Replacing the ferrite with a ferromagnetic metal-insulator laminate reduces the losses due to the spin waves generated at high frequencies. Each of the layers has a thickness less than the skin depth and wavelength of the radiation. Typical thickness that can be made are in the range of nanometers or less. The R.F. signal propagates in the circulator with the R.F. signal electric field being perpendicular to the layers 5, with the magnetic field being parallel to layers 5.

The resonant frequency is governed by different averages of the magnetic susceptibility μ and the dielectric constant ∈, $\langle\mu\rangle_a\langle\in\rangle_h$. Angular brackets with subscripts a and h stand for the arithmetic and harmonic means, respectively. Thus $1/\langle\in\rangle_h=C_m/\in_m+C_i/\in_i$. $C_j$ is the volume fraction of the particular component j or layer, and $\langle\mu\rangle_a=C_m\mu_m+C_i\mu_i$. The subscripts i, m refer to the insulator and ferromagnetic material respectively. Because the ferromagnetic material susceptibilities are much larger than that of the insulator, the harmonic mean of the dielectric constant is of the order of the insulator layer dielectric constant $\in_h=\in_i/C_i$. The arithmetic mean of the magnetic susceptibility is of the order of the ferromagnetic susceptibility $\langle\mu\rangle_a=C_m\mu_m$. The overall behavior of the device is one of a magnetic insulator.

For optimal operation, the magnetization of the multilayer generally should be perpendicular to the plane of interest, whereas, ordinarily, the magnetization of common magnetic films is along the plane. The current structures allow the flexibility of choosing a magnetic material with perpendicular anisotropy.

In another aspect of this disclosure, the ferromagnetic metal-insulator multilayer structure that replaces conventional ferrites may be implemented as a nano-structure. Because there are many choices of ferromagnetic metals and insulators available, by using this disclosure, R.F. circulators may now be made which work at higher frequencies than are conventionally available, with the added benefit that no external biasing magnetic field is necessary. In addition, because of the nano-structure device that may be built by this disclosure and the availability of thin-film processing techniques compatible with semiconductor integrated circuits, a circulators may now readily be integrated into monolithic integrated circuits, and thereby incorporated into integrated microwave devices and into smaller and lighter products, for example, a cellular telephone or other portable wireless device.

If common semiconductor processing techniques and materials are used, then the laminated structure may be formed by sputtering or chemical vapor deposition (CVD). Further, materials compatible with such processing may also include, as an insulator for example, Germanium (Ge) or other common dielectric materials now in use.

The foregoing description illustrates and describes various aspects of the inventive concept. Additionally, the disclosure shows and describes preferred embodiments in the context of a thorough magnetic metal-insulator multilayer radio frequency circulator, but, as mentioned above, it is to be understood that this disclosure is capable of use in various other combinations, modifications, and environments, and is capable of changes or modifications within the scope of the inventive concept as expressed herein, commensurate with the above teachings and/or the skill or knowledge of the relevant art.

The embodiments described hereinabove are further intended to explain best modes known of practicing the inventive concept, and to enable others skilled in the art to utilize the disclosure in such, or other, embodiments and with the various modifications required by the particular applications or uses of the invention. Accordingly, the description is not intended to be limited to the form or application disclosed herein. Also, it is intended that the appended claims be construed to include alternative embodiments.

The invention claimed is:

1. A directional R.F. circulator for directing a radio frequency signal which does not require an external magnetic field, the circulator comprising:

layers of ferromagnetic materials and an insulator forming a laminated structure, said layers each having a thickness that is less than a wavelength of said radio frequency signal and a skin depth of said radio frequency signal, said ferromagnetic materials and insulators forming a resonant cavity having a resonant frequency defined by an effective magnetic susceptibility and an effective dielectric constant of the laminated structure;

a first connector for supplying the radio frequency signal to said laminated structure so that a magnetic field is in a plane of said laminated structure and an associated electric field is perpendicular thereto;

a second connector connected to said laminated structure that couples a signal traveling in a first circular direction to an external circuit; and a third connector connected to said laminated structure that couples another signal traveling in a second circular direction to a different external circuit.

2. An RF circulator, comprising:

a laminated structure comprising at least one ferromagnetic material layer and at least one insulator layer, wherein said layers each have a thickness that is less than a wavelength and a skin depth of a first RF signal, wherein said at least one ferromagnetic material and said at least one insulator layer form a resonant cavity having a resonant frequency;

a first connector that couples said first RF signal to said laminated structure so that a magnetic field of said first RF signal is oriented in a plane of said laminated structure and an associated electric field is oriented perpendicular to the plane of said laminated structure; and a second connector that couples a second RF signal traveling in a first circular direction within the laminated structure to an external circuit.

3. The RF circulator of claim 2, wherein the laminated structure comprises multiple layers of each of the at least one ferromagnetic material and the at least one insulator layer.

4. The RF circulator of claim 2, wherein the at least one ferromagnetic material comprises a metal having a large perpendicular anisotropy.

5. The RF circulator of claim 2, wherein the at least one ferromagnetic material comprises cobalt.

6. The RF circulator of claim 2, wherein the at least one ferromagnetic material comprises platinum.

7. The RF circulator of claim 2, wherein the at least one ferromagnetic material comprises iron.

8. The RF circulator of claim 2, wherein the laminated structure is free of ferrite material.

9. The RF circulator of claim 2, wherein, by the arrangement of the laminated structure, the circulator is capable of operation without an external biasing magnetic field.

10. The RF circulator of claim 2, wherein a resonance frequency for an RF signal propagating in a clockwise direction is different from an RF signal propagating in a counter-clockwise direction.

11. The RF circulator of claim 2, wherein the insulator comprises Germanium.

12. An integrated semiconductor circuit comprising the RF circulator of claim 2.

13. A cellular telephone comprising the RF circulator of claim 2.

14. The RF circulator of claim 2, further comprising:

a third connector that couples a third RF signal traveling in a second circular direction within the laminated structure to a different external circuit.

15. The RF circulator of claim 14, wherein the laminated structure forms a different resonant cavity with a different resonant frequency that is arranged to interact with and couple the third RF signal traveling in the second circular direction out of the third connector.

16. A method of forming an RF circulator, the method comprising:

providing two conductive ground planes;

arranging a laminate structure comprising alternating layers of insulation and ferromagnetic material between the two conductive ground planes so as to form at least one resonant cavity;

providing an input coupling; and providing at least one output connector, wherein each layer of the laminate structure has a thickness chosen to be less than both a skin depth and a wavelength of a desired RF operating frequency.

17. The method of claim 16, further comprising reducing eddy currents produced in said laminated structure.

18. The method of claim 16, wherein said providing at least one output connector comprises providing two output connectors, each of said two output connectors being arranged with respect to the laminated structure so as to couple a different circularly traveling RF signal to a respective output connector.

19. The method of claim 16, wherein said laminate structure is formed by sputtering.

20. The method of claim 16, wherein said laminate structure is formed by CVD.

* * * * *